US011053675B1

(12) United States Patent
Santandreu

(10) Patent No.: US 11,053,675 B1
(45) Date of Patent: Jul. 6, 2021

(54) CONSTRUCTION PANEL AND CONSTRUCTION PANEL ASSEMBLY WITH IMPROVED STRUCTURAL INTEGRITY

(71) Applicant: Juan Jose Santandreu, Hialeah, FL (US)

(72) Inventor: Juan Jose Santandreu, Hialeah, FL (US)

( * ) Notice: Subject to any disclaimer, the term of this patent is extended or adjusted under 35 U.S.C. 154(b) by 0 days.

(21) Appl. No.: 16/430,745

(22) Filed: Jun. 4, 2019

Related U.S. Application Data

(60) Provisional application No. 62/768,859, filed on Nov. 17, 2018.

(51) Int. Cl.
*E04B 1/16* (2006.01)
*E04B 5/17* (2006.01)
*E04B 2/84* (2006.01)

(52) U.S. Cl.
CPC ..... *E04B 1/167* (2013.01); *E04B 2/845* (2013.01); *E04B 2/847* (2013.01); *E04B 5/17* (2013.01)

(58) Field of Classification Search
CPC ..... E04L 1/167
See application file for complete search history.

(56) References Cited

U.S. PATENT DOCUMENTS 3,879,908 A * 4/1975 Weismann ..... B21F 27/128 52/309.5
5,050,362 A 9/1991 Tal et al.
5,207,045 A 5/1993 Bodnar
5,373,674 A 12/1994 Winter, IV
5,921,046 A 7/1999 Hammond, Jr.
6,185,890 B1 * 2/2001 Ritter ..... E04C 2/044 52/251

(Continued)

FOREIGN PATENT DOCUMENTS

CN 106760143 A * 5/2017
DE 4126140 A1 1/1993

(Continued)

OTHER PUBLICATIONS

US 5,844,223 A1, 09/2014, Zhong (withdrawn)

(Continued)

*Primary Examiner* — Babajide A Demuren
(74) *Attorney, Agent, or Firm* — Hanrahan Law Firm, P.A.; Benjamin M. Hanrahan

(57) ABSTRACT

A building construction panel and a building construction panel assembly are presented herein. The panel includes a foam insulation core with first and second oppositely disposed nonlinear longitudinal surfaces, each of the first and second nonlinear longitudinal surfaces include a plurality of pockets defined by a plurality of peaks and a plurality of troughs. A reinforcement mesh panel is disposed along at least a portion of each of the first and second longitudinal surfaces of the foam core. Reinforcing bars are positionable at least partially within the pockets of the surfaces of the foam core, and concrete is layered on top of the surfaces of the foam core and the mesh reinforcement panels to secure the reinforcing bars therein. In some embodiments, the reinforcing bars are positioned between the surface of the foam core and the mesh reinforcing panel.

19 Claims, 9 Drawing Sheets

(56) References Cited

U.S. PATENT DOCUMENTS

| | | | | |
|---|---|---|---|---|
| 6,226,942 | B1 * | 5/2001 | Bonin | E04B 5/04 52/309.11 |
| 6,272,805 | B1 * | 8/2001 | Ritter | E04C 2/044 52/309.11 |
| 6,434,900 | B1 | 8/2002 | Masters | |
| 6,519,904 | B1 * | 2/2003 | Phillips | E04B 2/845 52/309.12 |
| 6,848,228 | B1 | 2/2005 | Williams | |
| 7,143,559 | B1 * | 12/2006 | Ritter | E04C 2/044 52/309.7 |
| 8,844,227 | B1 | 9/2014 | Ciuperca | |
| 9,038,339 | B2 | 5/2015 | Zhong | |
| 2004/0065034 | A1 * | 4/2004 | Messenger | E04C 2/044 52/309.11 |
| 2010/0058700 | A1 | 3/2010 | LeBlang | |
| 2011/0036031 | A1 * | 2/2011 | Candiracci | E04B 5/266 52/309.6 |
| 2012/0073227 | A1 * | 3/2012 | Urusoglu | E04B 1/161 52/309.4 |
| 2012/0317923 | A1 | 12/2012 | Herdt et al. | |
| 2013/0019549 | A1 | 1/2013 | Henriquez | |
| 2014/0115988 | A1 | 5/2014 | Sievers et al. | |
| 2014/0115989 | A1 | 5/2014 | Sievers et al. | |
| 2015/0300018 | A1 | 10/2015 | Thiercelin | |
| 2015/0322664 | A1 * | 11/2015 | Manning | E04B 5/32 52/742.15 |

FOREIGN PATENT DOCUMENTS

| | | | | |
|---|---|---|---|---|
| EP | 1106745 | A2 * | 6/2001 | E04B 5/023 |
| WO | 2012144880 | A2 | 10/2012 | |
| WO | WO-2014045244 | A2 * | 3/2014 | E04C 2/06 |
| WO | WO-2019007224 | A1 * | 1/2019 | B28B 23/04 |

OTHER PUBLICATIONS

Schwoerer Hans, EP1106745_Machine_translate.pdf (Year: 2000).*

Luo Jianliang, Machine_Translate_WO2019007224A1_Description_202007311240.pdf (Year: 2019).*

Machine-Generated English Translation of DE4126140 obtained at <https://translationportal.epo.org/emtp/translate/?ACTION=description-retrieval&COUNTRY=DE&ENGINE=google&FORMAT=docdb&KIND=A1&LOCALE=en_EP&Number=4126140&SRCLANG=de&TRGLANG=en>.

"Baupanel System S.L. Seismic-resistance, thermally-insulating building system—ENGLISH" via YouTube.com | screenshot and webpage printout from <https://www.youtube.com/watch?v=SPPE9XgeOyl&t=>, available May 18, 2010 (2010).

"Baupanel comercial video" via YouTube.com | screenshot and webpage printout from <https://www.youtube.com/watch?v=XvvNiRGIrGY>, available Sep. 26, 2016 (2016).

* cited by examiner

CONSTRUCTION PANEL AND CONSTRUCTION PANEL ASSEMBLY WITH IMPROVED STRUCTURAL INTEGRITY

CLAIM OF PRIORITY/CROSS REFERENCE TO RELATED APPLICATION

The present application is based on and a claim to priority is made under 35 U.S.C. § 119(e) to currently provisional patent application Ser. No. 62/768,859, having a filing date of Nov. 17, 2018, the contents of which are incorporated herein in their entirety by reference.

FIELD OF THE INVENTION

The present invention is generally directed to a construction panel that can be used to fabricate or construct interior or exterior walls and/or a roof of a building, such as that of virtually any residential or commercial building. The construction panel includes a foam-based or insulated core and two parallel mesh panels separated by a plurality of connectors. The foam or insulated core includes oppositely facing longitudinal surfaces, each with an irregular wave-like configuration. In some cases, reinforcing bars or anchor dowels (e.g., affixed to and extending up from the foundation of a building) are positioned between the foam core and the mesh panels in a space created by the irregular wave-like configuration. The reinforcing bars or dowels are secured in place with a concrete spray, such as shotcrete or other like material. Due to the configuration of the surfaces of the core, the reinforcing bars will be substantially or completely surrounded by the concrete.

BACKGROUND OF THE INVENTION

Foam-based construction panels used in the construction industry are known. Some foam-based construction panels may include a wire or steel mesh reinforcement panel overlaying opposite sides of a foam core. The foam core and the mesh reinforcement panels may be positioned adjacent structural rebar affixed in the foundation of a building. Concrete can then be sprayed upon the outwardly facing surfaces of the foam core, covering the foam core, the mesh reinforcement panel and the structural rebar.

In some cases, the foam core of known construction panels may include wave-like configuration such that, when the concrete is sprayed, the valleys defined by the wave-like surface are filled with the concrete, thereby increasing the structural integrity of the wall. However, the specific shape and/or size of the wave-like surface configuration of the foam core does not coincide with the spacing of the rebar affixed to the foundation of the structure. This causes many of the rebar to abut against the outermost point or peak of the surface. In this manner, when the concrete is sprayed, no or very little concrete will be filled in behind the rebar abutting against the peaks or outermost points of the surface of the core. More specifically, the rebar abutting against or proximate one of the peaks will not have any or any significant amount of concrete behind it, or between it and the core. This creates a structural weakness point in the wall.

Furthermore, the rebar will be placed on the outside surface of the mesh reinforcement panel of known foam core construction assemblies. This can create a contact point between the rebar and the mesh reinforcement panel that will not have concrete in between. Again, this can create a structural weakness point in the wall construction.

There is thus a need in the art for an improved and new foam construction panel that overcomes these and other drawbacks.

SUMMARY OF THE INVENTION

Accordingly, the present invention is directed to a construction panel and construction panel assembly with improved structural integrity characteristics. Specifically, the construction panel of at least one embodiment is a composite bearing panel, such as a wall and/or roof panel, with an EPS, XPS or other like foam or insulated core. For instance, the panel of at least one embodiment includes a foam core with first and second opposite sides or longitudinal surfaces. The core of the construction panel of at least one embodiment can be constructed of a polystyrene insulation material, such as, but not limited to extruded polystyrene insulation (XPS) or expanded polystyrene insulation (EPS). Other materials in addition to or instead of XPS and EPS may be used in the full spirit and scope of the present invention. Furthermore, the opposite longitudinal surfaces of the core may include a nonlinear surface configuration, such as, for example, as represented by a waveform or wave-like pattern extending horizontally from one end of the core to another.

The surface configuration of at least one embodiment of the foam core is constructed such that a plurality of structural rebar (for example, rebar affixed to the foundation of the structure) or a plurality of dowels are positioned within one of the pockets or valleys defined by the waveform patterned surface. In some embodiments, each one or all of the rebar or dowels are positioned on the inside of the mesh panel (e.g., between the foam core and the mesh panel), although in other embodiments one, some or all of the rebar or dowels may be positioned externally to the mesh panel.

Further embodiments of the foam core may include an irregular surface configuration on the longitudinal surfaces, meaning that the waveform pattern disposed on or defining the first and second longitudinal surfaces of the core may be represented by an irregular waveform. In this regard, in at least one embodiment, at least one of the peaks disposed on a common surface is not longitudinally or horizontally aligned with every one of the other peaks on the same surface. Similarly, in one embodiment, at least one of the troughs on one of the longitudinal surfaces is not aligned with every one of the other troughs on the same surface. Furthermore, in at least one embodiment, the various peaks and/or troughs may be spaced apart different distances from one another in that the peaks and/or troughs defined on the surfaces may not be uniformly spaced from one another. In other words, the distance from one peak to an adjacent peak may be different that the distance between two other adjacent peaks on the same surface. In any event, the irregular surface configuration creates a plurality of different pockets or valleys between the wave-like surface and the mesh panel within which the structural rebar or dowels can be positioned without sacrificing insulating properties or structural integrity of the foam core.

For example, each of the structural rebar or dowels of some embodiments of the present invention may be disposed within the pockets defined by the various peaks and valleys of the foam core and in some cases spaced away from the surface of the core. This allows concrete to surround the backside or inside surface of the rebar, or otherwise allows the concrete to penetrate between the rebar and the foam core surface. This creates a construction panel with improved structural integrity properties without sacrificing insulation properties of the foam core.

In addition, the irregular surface configuration of the core causes almost all of the mesh panel to be fully encased by the concrete or shotcrete. For example, while the mesh panel may touch one or some of the peaks (e.g., the largest peak) of the irregular surface configuration, the mesh panel may not touch the next or adjacent peak or other peaks. In this manner, there will be a space between some (or in some cases, most) of the peaks and the mesh panel. This allows concrete or shotcrete to fully surround the mesh panel not only adjacent the pockets or troughs, but also adjacent some or most of the peaks as well. This creates a panel with an extremely high amount of structural integrity and strength.

A further advantage of at least one embodiment of the present invention is that when the structural rebar or support bars are disposed on the inside of the mesh panel (e.g., between the mesh panel and the core), the layer of concrete or shotcrete external to the mesh panel will be homogeneous. In other words, with the structural rebar or beams on the inside of the mesh panel, the concrete layer external to the mesh panel is not interrupted by the rebar or structural beams/bars. Without the interruption external to the mesh panel, the concrete layer of at least one embodiment of the present invention has an extremely high amount of structural integrity.

These and other objects, features and advantages of the present invention will become more apparent when the drawings as well as the detailed description are taken into consideration.

BRIEF DESCRIPTION OF THE DRAWINGS

Like reference numerals refer to like parts throughout the several views of the drawings provided herein.

DETAILED DESCRIPTION OF THE INVENTION

Figure 1:
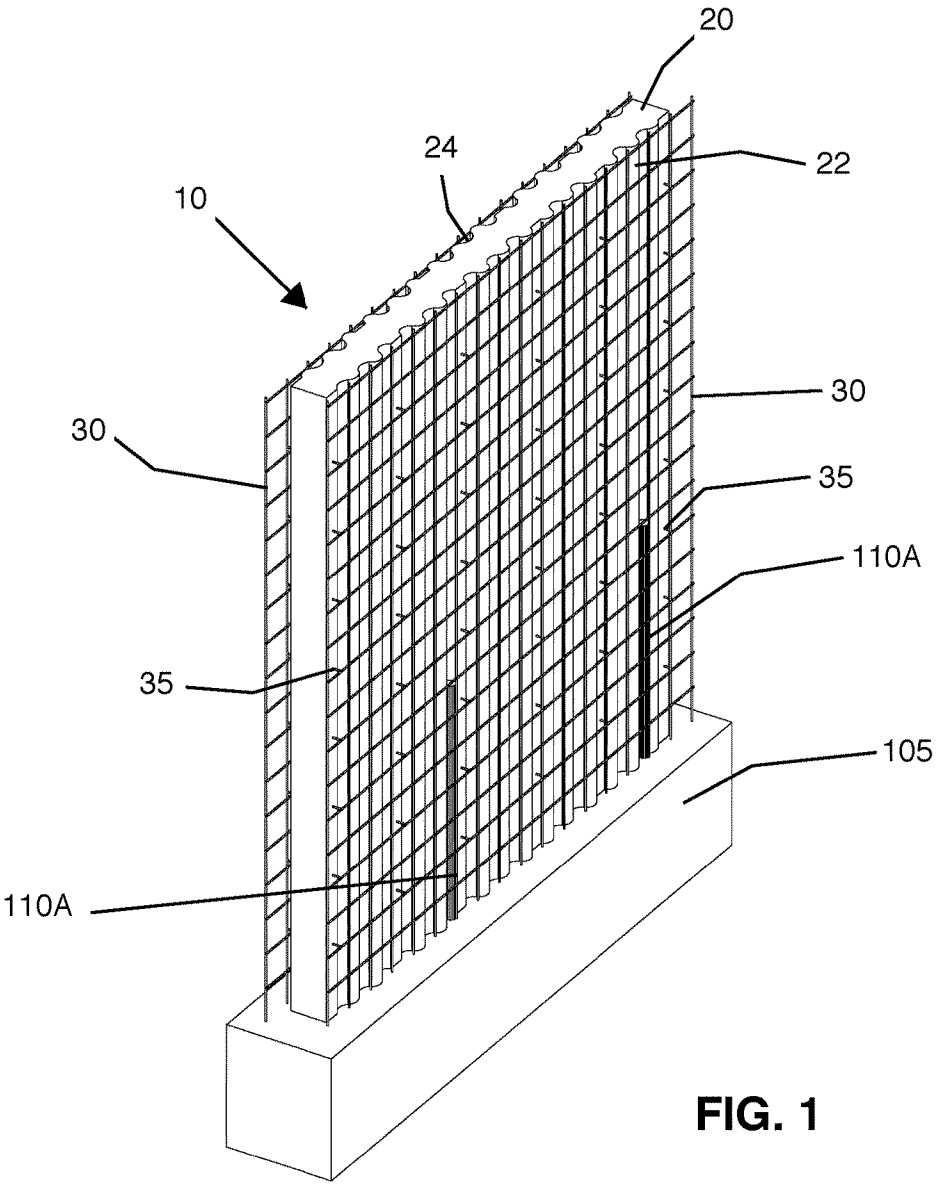
FIG. 1 is a side perspective view of a construction panel in position relative to reinforcement dowels as disclosed in accordance with at least one embodiment of the present invention.
Figure 2:
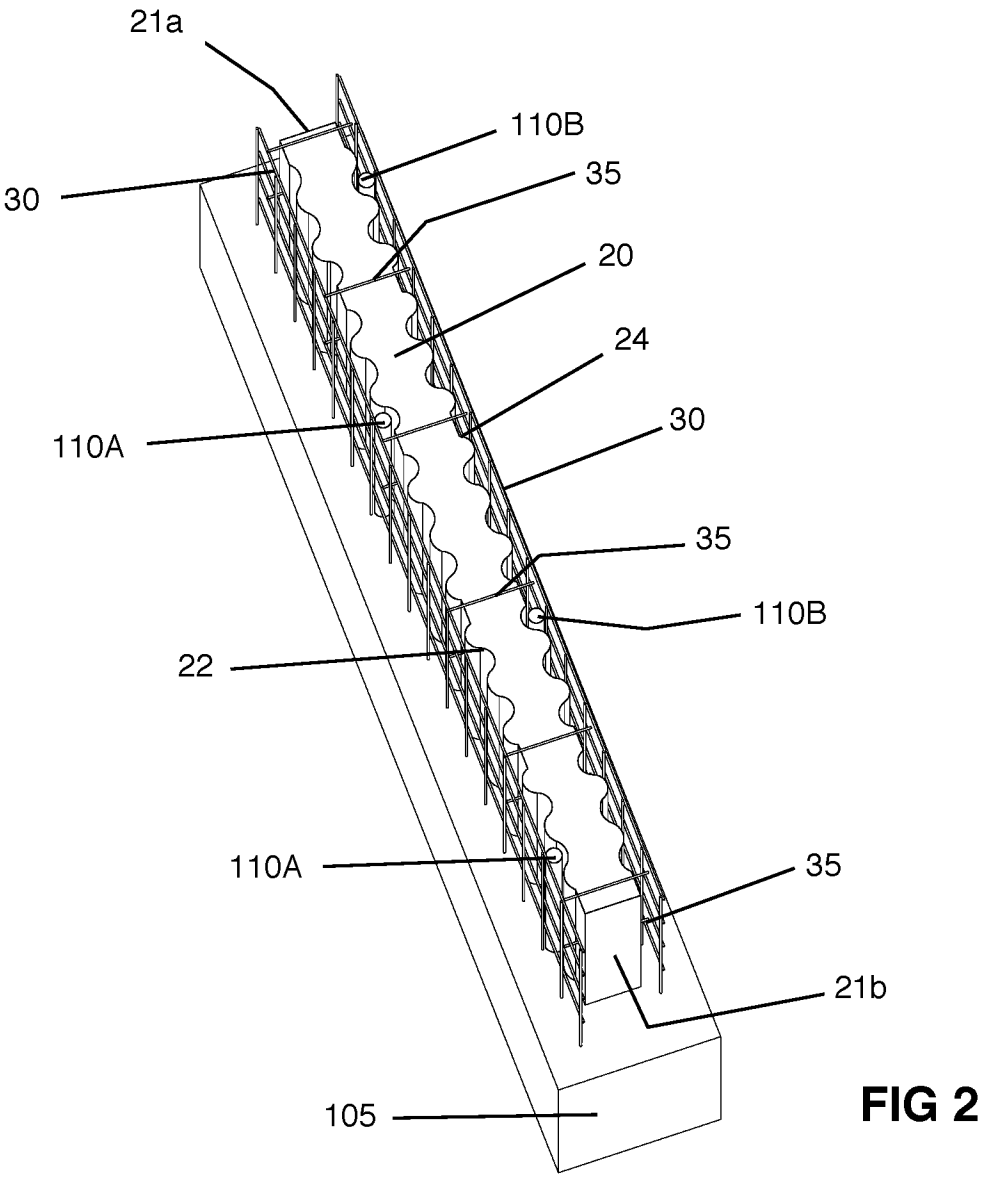
FIG. 2 is a top perspective cut-away view of the embodiment illustrated in FIG. 1.

As shown in the accompanying drawings, and with particular reference to FIGS. 1 and 2, for example, the present invention is directed to a construction panel, generally referenced as 10. As described herein, the construction panel 10 of at least one embodiment includes an inner foam base or insulating core 20 defining opposing longitudinal surfaces 22, 24. A mesh panel 30 is disposed along or adjacent each of the opposing longitudinal surfaces 22, 24, for example, in a covering relation thereto. In some embodiments, a plurality of connectors 35 are connected to and between the mesh panels 35, for example, through the core 20.

A construction panel assembly 100 may be created by using a plurality of panels 10 assembled together, for example, in a side-by-side or stacked manner, positioned with a plurality of reinforcing bars (rebar) or dowels 110A, 110B in the manner described herein, and with a layer of concrete or shotcrete 50 sprayed or disposed thereupon.

Accordingly, the construction panel(s) 10 and construction panel assembly 100 of the various embodiments disclosed herein can be used to construct the internal walls, external walls, floor or roof of a building or other structure, including, but not limited to a residential structure, such as a house, apartment building, etc., as well as a commercial or government structure including an office building, retail establishment, etc. Virtually any structural building, whether one or more stories, and regardless of the shape, size, dimension, or floor plan, can be built or constructed using the construction panel 10 and assembly 100 disclosed herein. The walls can include load-bearing walls, non-load-bearing walls, simple partition walls, etc.

More in particular, and still referring to FIGS. 1 and 2, the construction panel 10 of at least one embodiment includes an inner core or body 20. The inner core or body 20 of at least one embodiment can be constructed of a material having high insulation properties and, in many cases, also sufficient structural rigidity. Accordingly, the core or body 20 of the construction panel 10 of at least one embodiment can be constructed of a polystyrene insulation material, such as, but not limited to extruded polystyrene insulation (XPS) or expanded polystyrene insulation (EPS). In one exemplary embodiment, the core 20 may include a minimum density of 0.9 pounds per cubic foot (pcf), a flame spread factor of 5 (ASTM E-84), a smoke development factor of 400 (ASTM E-84), a self-ignition temperature of 878 degrees Fahrenheit (ASTM 01929), and be fungal and bacterial resistant. Other materials in addition to or instead of XPS and EPS may be used in the full spirit and scope of the present invention.

As described herein, and with reference to the top view of FIG. 2, each core 20 may be defined as including opposite ends 21*a*, 21*b*, and opposite longitudinal sides or surfaces 22, 24. The longitudinal sides or surfaces 22, 24 of at least one embodiment define an irregular or nonlinear surface configuration which may include an irregular wave pattern such that not all of the peaks and troughs are identical. For instance, some peaks may be flat, while other peaks may represent a smooth curve. Furthermore, some peaks may be larger than other peaks, (e.g., some peaks may extend closer toward or to the mesh panel 30 than others).

Furthermore, one or more reinforcement or mesh panels 30 may be disposed at least partially against, along or proximate to the opposite longitudinal surfaces 22, 24 of the core 20. For instance, in at least one exemplary embodiment, the reinforcement mesh panel 30 includes a mesh-like construction or configuration that can be made out of a plurality of intersecting or perpendicular reinforcing or reinforcement bars (e.g., rebar or steel bars). The two mesh panels 30 of at least one embodiment are connected to one another with cross connectors 35, as shown in FIGS. 1 and 2. the connectors 35 of at least one embodiment extend perpendicularly between the two opposing mesh panels 30.

Figure 5A:
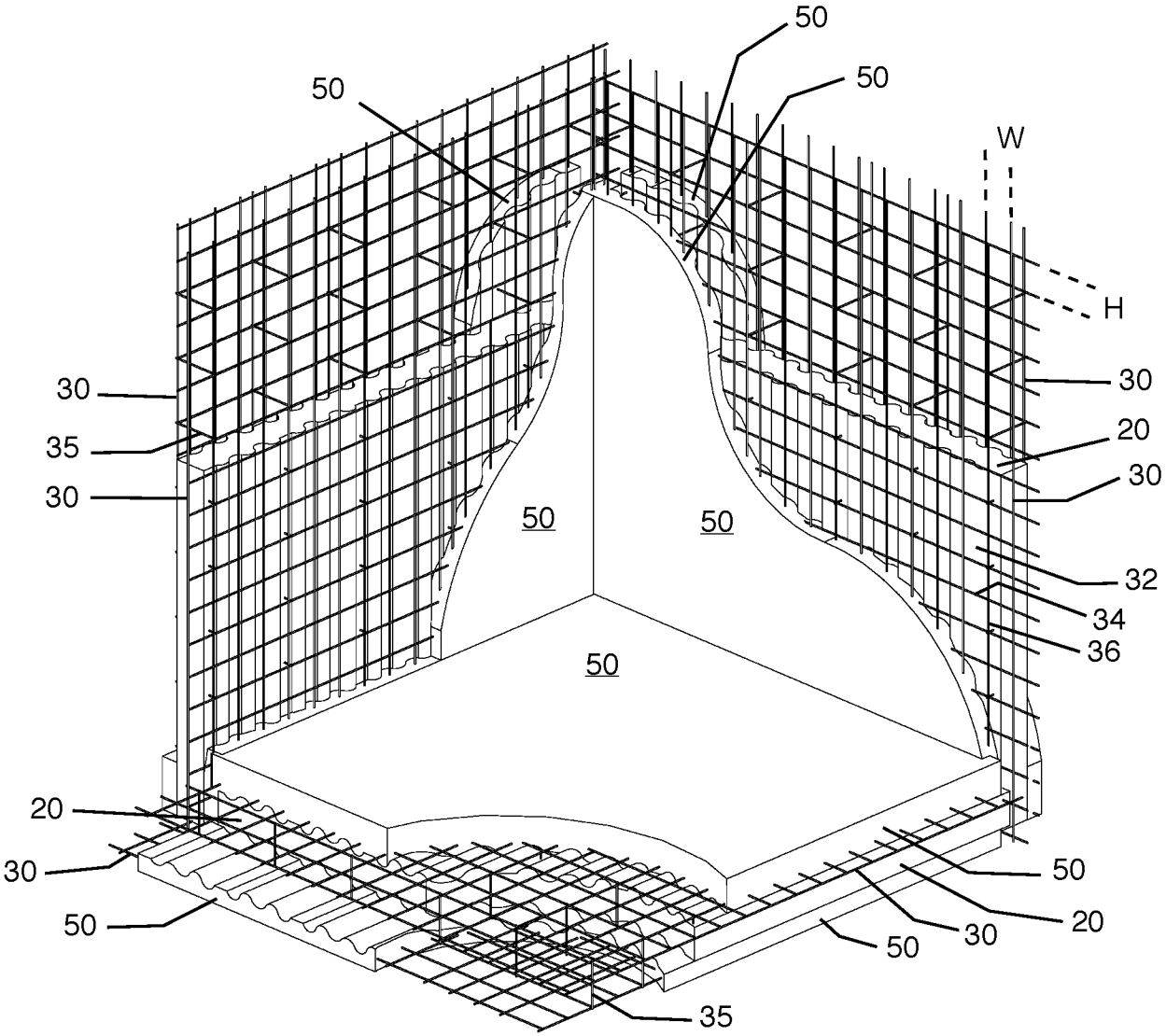
FIG. 5A is a perspective view of an exemplary construction panel assembly 10 of at least one embodiment of the present invention with portions of the cores, mesh panels, and concrete layers removed for illustrative purposes.

As shown, for example, in FIG. 5A, in some embodiments or applications, the reinforcement or mesh panel(s) 30 includes a plurality of mesh openings 32 defined by the intersecting bars or pieces 34, 36. The openings 32 may include a square or rectangular configuration, as shown, with a width W and a height H. In some embodiments, the openings 32 may be symmetrical, meaning that the width W and height H are equal to one another.

In one exemplary embodiment, the openings 32 or square-shaped mesh holes in the panel(s) 30 are approximately three (3) inch by three (3) inch in dimension, or in other words, include a width W of approximately three (3) inches and height H of approximately three (3) inches. Other sized mesh panels or reinforcement panels 30 can be used in accordance with the present invention, with different sized openings 32, for example, depending on the type of structure being constructed, the reinforcement or structural integrity needs of the building, etc.

In one exemplary embodiment, the mesh panel 30 is constructed of galvanized steel welded in a mesh pattern that has a minimum yield limit of 80,000 psi. A plurality of longitudinal 36 and transversal 34 bars may be approximately 11 gauge and/or approximately 0.12 inches or 3 millimeters in diameter. Two parallel mesh panels 30 are spaced from one another and connected via a plurality of connectors 35. The connectors 35 of at least one embodiment are also approximately 11 gauge and/or approximately 0.12 inches or 3 millimeters in diameter. The result is a reinforcement of 3-inch×3-inch×3 mm in compliance with ASTM A 1064.

It should be noted that in at least one embodiment, the panels 10 are assembled via a paneling machine using the core 20 and two mesh panels 30. The core 20 is sandwiched between the two mesh panels 30 and the paneling machine will weld the connectors 35 to create the panel 10 of at least one embodiment. This will typically be done off-site allowing for a monolithic wall panel to be constructed and brought to the construction site. At the construction site, the panels 10 are placed in a manner to define a wall, floor or roof. Then, shotcrete or a concrete layer is added to the outside surfaces of the panels 10 to create the assembly 100.

For instance, with reference again to FIGS. 1 and 2, the construction panel 10 of at least one embodiment may be positioned in a manner such that a plurality of reinforcing bars or dowels 110A and 110B are positioned on or proximate to opposite longitudinal sides or surfaces of 22, 24 of the core 20. Specifically, a first set of reinforcing bars 110A are positioned or disposed along or proximate a first surface 22 of the panel 10 or core 20, and a second set of reinforcing bars 110B are positioned or disposed along or proximate a second surface 24 of the panel 10 or core 20, wherein the first surface 22 and second surface 24 are opposite one another.

Moreover, as shown in FIGS. 1, 2 and 6A-6C, a plurality of reinforcing bars or dowels 110A and 110B may be secured to a foundation 105 of a building or other structure, such as a concrete slab or other like surface. The foundation or concrete slab 105 may be a concrete or other secure base through or within which the plurality of reinforcing bars 110A and 110B are disposed or projected. In some embodiments, the bars or dowels 110A, 110B may extend at least seven (7) inches into the foundation or slab 105 and extend at least seventeen (17) inches upward or out of the foundation or slab 105. Other dimensions are contemplated, for example, based on the application, structure, or building being constructed. For instance, the depth of the bars or dowels 110A, 110B into the concrete slab or foundation, as well as the height of which the bars or dowels 110A, 100B extend above the concrete slab or foundation may vary and may be designed by the engineer of record. Furthermore, the depth or thickness of the concrete slab or foundation may also vary and may be designed by the engineer of record. It should also be noted, however, that the reinforcing bars or dowels 110A and 110B may not necessarily be secured to or projecting from a foundation, which may be particularly true in multi-story constructions, or roof constructions, and thus the scope of the present application should not be limited to such.

Figure 4:
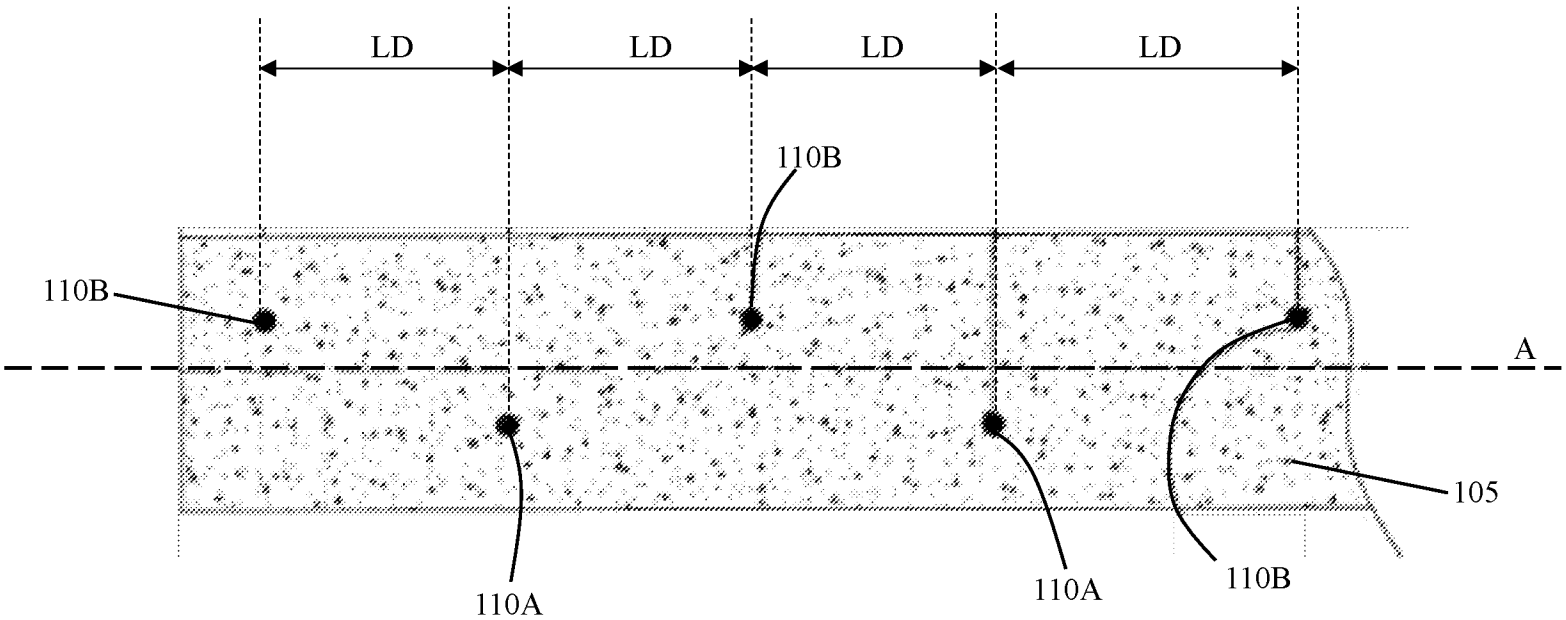
FIG. 4 is a top view illustrating an exemplary layout for a plurality of reinforcement bars disclosed in accordance with at least one embodiment of the present invention.

In FIG. 4, the bars or dowels 110A, 110B are shown as being disposed in a staggered distribution pattern along the concrete or foundation 105. Specifically, the bars or dowels 110A, 110B are disposed a longitudinal distance LD from one another, and alternating between first and second sides of center axis A, as shown. For instance, a first set of bars or dowels 110A are disposed on one side of the center axis A, and a second set of bars or dowels 110B are disposed on another side of the center axis A. In this manner, each of the bars or dowels 110A from the first set will be disposed on one longitudinal side 22 of the core 20, whereas the other bars or dowels 110B from the second set will be disposed on the other longitudinal side 24 of the core. In at least one exemplary embodiment, the longitudinal distance LD between each of the alternating bars or dowels 110A, 110B is approximately 13.5 inches, although other distances are contemplated.

Figure 3:
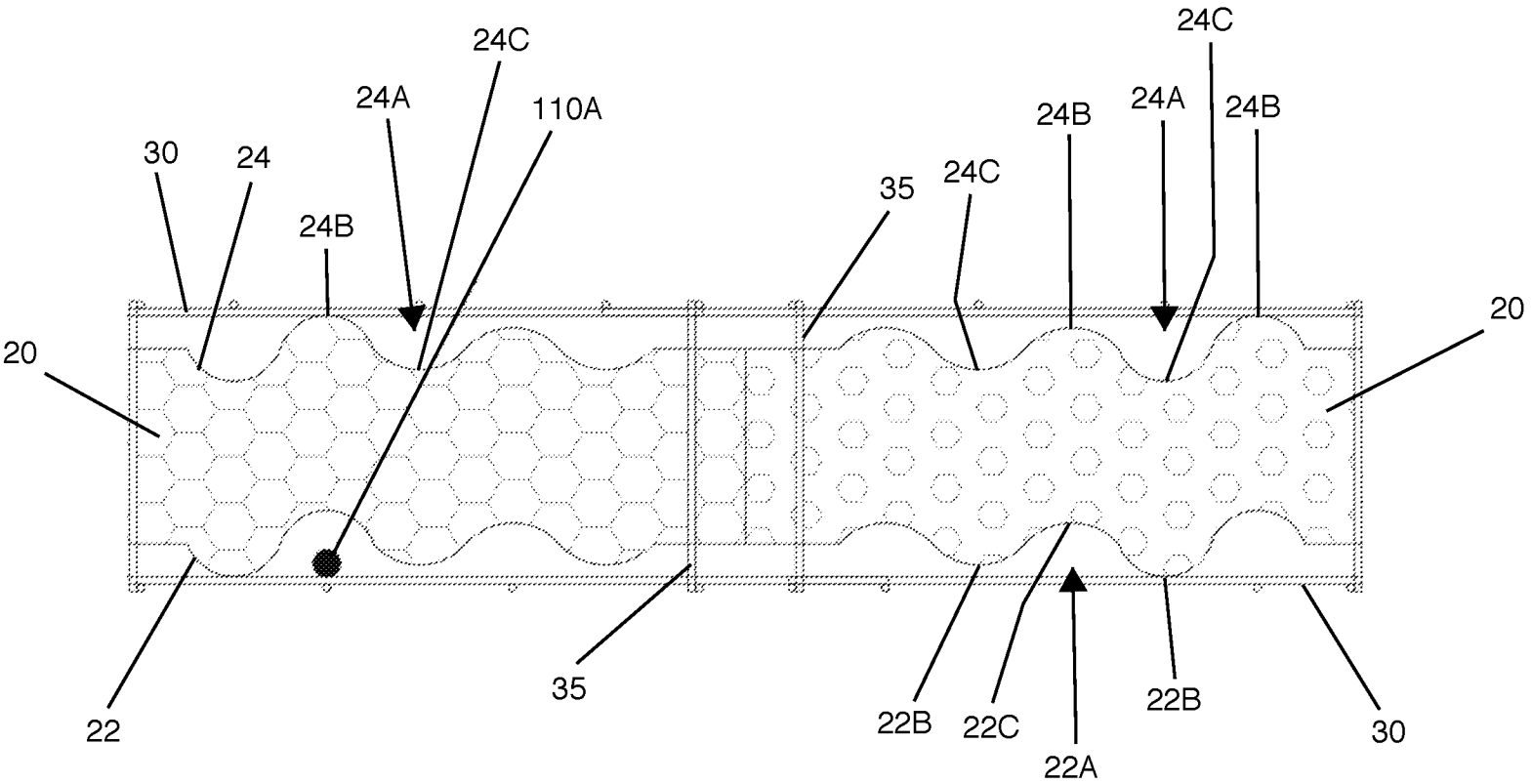
FIG. 3 is a top view of an exemplary construction panel as disclosed in accordance with at least one embodiment of the present invention.

Referring to FIGS. 1, 2 and 3 the first and second longitudinal surfaces 22, 24, respectively, of the base or core 20 may include a nonlinear or irregular surface configuration. For example, a plurality of pockets 22A, 24A are formed or defined along the surfaces 22, 24 of the cores. These pockets 22A, 24A are formed or defined by a series of alternating peaks 22B, 24B and troughs 22C, 24C disposed along the length of the core 20.

Also, as shown in FIGS. 2A, 2B, and 2C, the reinforcing mesh panel(s) 30 are disposed along, at least partially against or proximate to the first and second nonlinear or longitudinal surfaces 22, 24 such that the mesh 30 may, in some cases, only contact or engage some of the peaks 22B, 24B and none of the troughs 22C, 24C.

The configuration of the nonlinear surfaces 22, 24 of the core 20, and in particular, the pockets 22A, 24A defined thereby, are such that when the core 20 and mesh panel 30 are set into place relative to the reinforcing bars or dowels 110A, 110B, the reinforcing bars or dowels 110A, 110B of at least one embodiment do not engage or touch the peaks 22B, 24B or in some embodiments the troughs 22C, 24C.

Furthermore, in at least some embodiments, the reinforcing bars or dowels 110A, 110B are positioned at least partially within the pockets 22A, 22B defined by the alternating peaks 22B, 24B and troughs 22C, 24C. For instance, with the reinforcing mesh panel 30 disposed at least partially against or proximate some of the peaks 22B, 24B, the reinforcing bars 110A, 110B can be positioned between the nonlinear longitudinal surfaces 22, 24 of the core 20 and the reinforcing mesh 30. In other words, the bars or dowels 110A, 110B of at least one embodiment are each disposed on the inside surface of the reinforcement or mesh panel 30, or the surface of the mesh panel 30 that faces the core 20. This is particularly true for load bearing walls. For non-load bearing walls or partition walls, the bars or dowels may be positioned on the outside surface of the mesh panels 30.

Figure 5B:
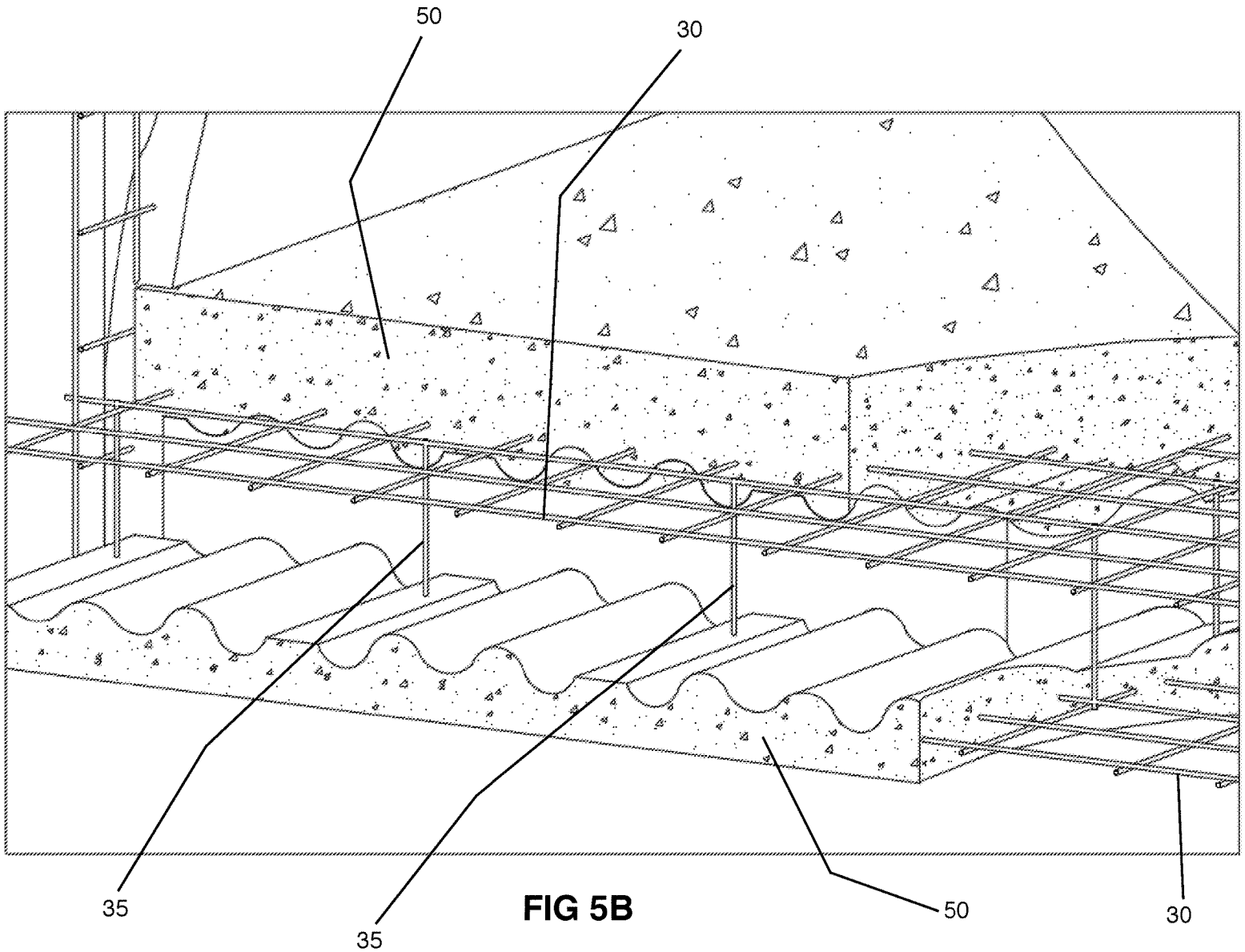
FIG. 5B is a perspective and cut away view of an exemplary construction panel assembly of at least one embodiment with the core removed and potions of the concrete layers removed for illustrative purposes.
Figure 6A:
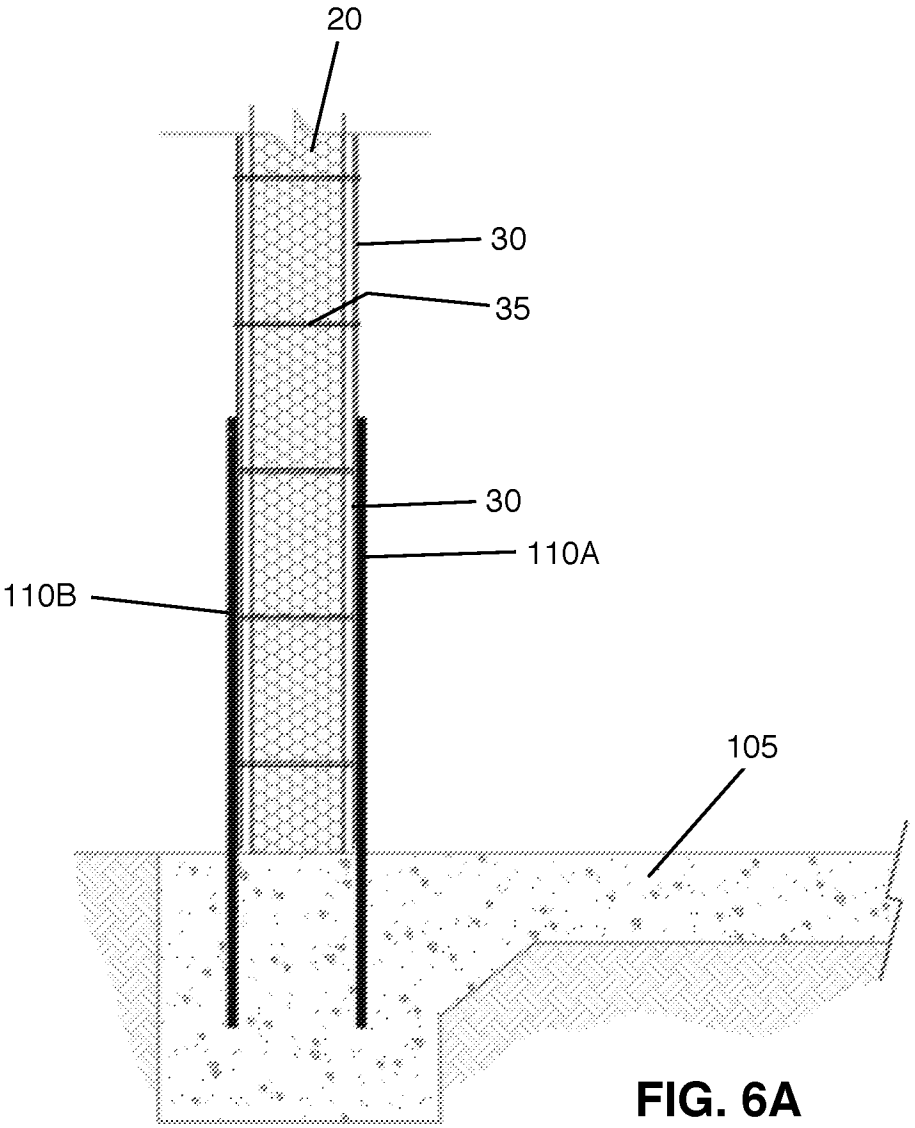
FIG. 6A is a side sectional view illustrating the construction panel assembly with two reinforcement bars disposed within a foundation and extending upward on the outside surface of the mesh panel, as disclosed in accordance with at least one embodiment of the present invention.
Figure 6B:
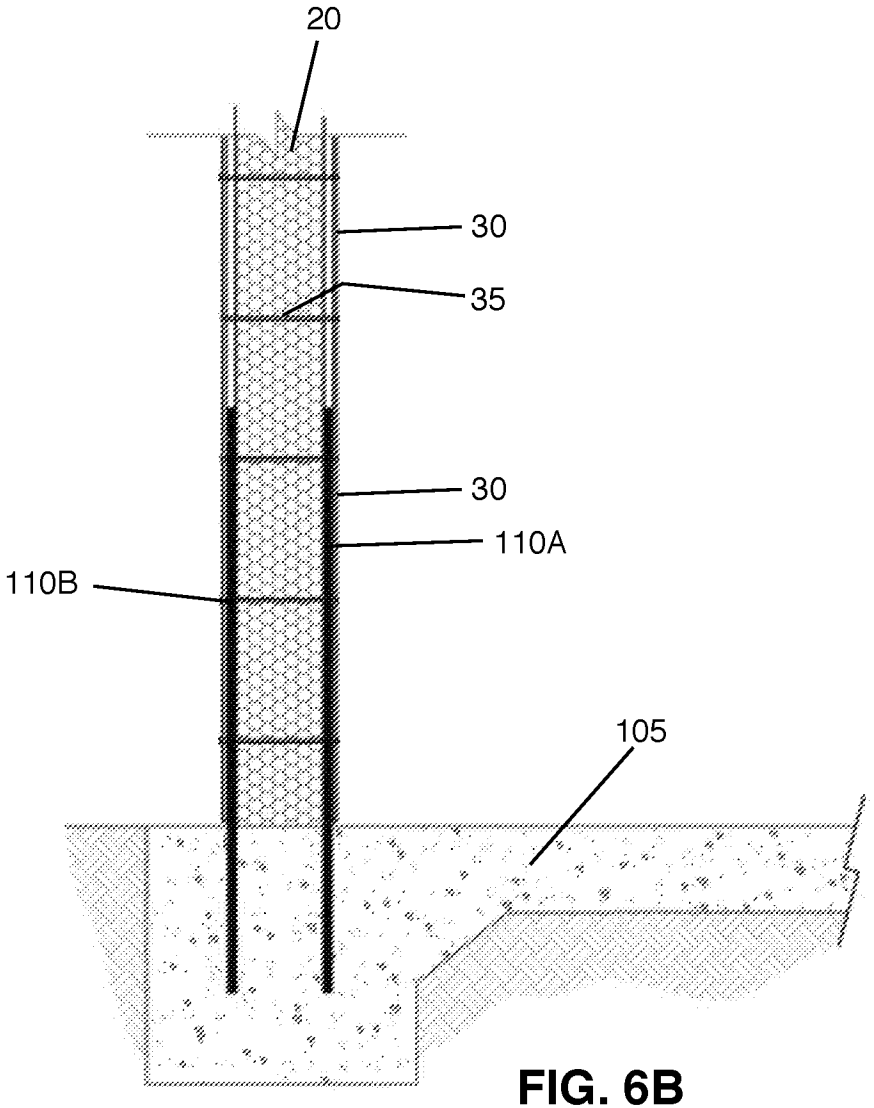
FIG. 6B is a side sectional view illustrating the construction panel assembly with two reinforcement bars disposed within a foundation and extending upward on the inside surface of the mesh panel, as disclosed in accordance with at least one embodiment of the present invention.
Figure 6C:
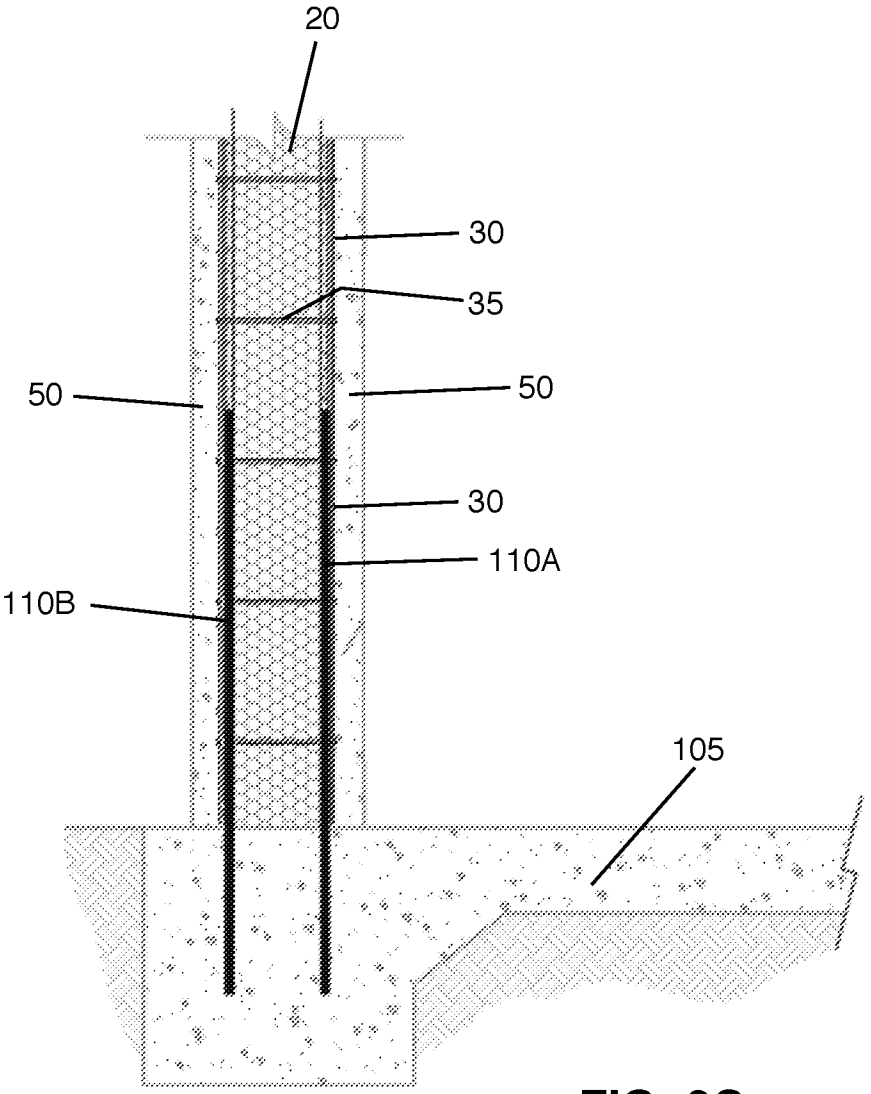
FIG. 6C is a side sectional view of the embodiment illustrated in FIG. 6B with concrete or shotcrete disposed on the outer surface of the core and mesh panel.

In any event, once the core 20 and mesh panel 30 are in place, for example, relative to the plurality of reinforcing bars 110A, 110B, a layer of concrete 50, mortar, or other like composite or surfacing material that will harden over time is placed over each of the surfaces 22, 24 of the core 20, covering the surfaces 22, 24, the reinforcing mesh panel 30 and the reinforcing bars 110, as shown in FIGS. 5A and 5B, for example. The concrete 50, mortar or other material can be sprayed onto the surfaces 22, 24 of the core, although other methods of applying the concrete 50 or other material may be used in the full spirit and scope of the present invention.

In at least one exemplary embodiment, the concrete 50 is shotcrete applied via a spray concrete machine. The shotcrete may have a high-strength of 3,500 psi at 28 days to create a monolithic wall with a maximum aggregate size of ¼ inch or 3/16 inch.

It should be noted that, in some embodiments, the reinforcing bars or dowels 110A, 110B do not touch or engage any surface of the core 20, and further, the reinforcing bars 110 of some embodiments may be completely or substantially disposed within a pocket 22A, 22B, on the inside surface of the mesh panel 30. In such a manner, the concrete 50 or other material can substantially and in some cases completely surround the entire circumference or outer surface of the reinforcing bars 110A, 110B. This provides an increased and significant amount of structural integrity to the panel 10 and the building structure, as a whole.

In some embodiments, one or more of the reinforcement bars or dowels 110A, 110B may at least partially touch or engage the inside surface of the mesh panel 30. In such a case, the reinforcement bars or dowels 110A, 110B may be positioned between peaks 22B, 24B or otherwise not against a peak 22B, 24B. This allows for a thick layer of concrete to be disposed between each of the reinforcing bars 110A, 110B and the surface 22, 24 of the core 20, thereby providing a significant amount of structural integrity.

Furthermore, as represented in exemplary FIGS. 1, 2 and 3, the nonlinear first and second longitudinal surfaces 22, 24 of the core 20 can be defined by an irregular wave pattern, meaning that at least some of the peaks 22B, 24B are not horizontally or longitudinally aligned with one another, and/or at least some of the troughs 22C, 24C are not horizontally or longitudinally aligned with one another. For instance, some of the troughs 22C, 24C may extend deeper into the core 20 than other troughs 22C, 24C. Similarly, some of the peaks 22B, 24B may extend farther outward than other peaks 22B, 24B. This irregular surface configuration creates a series of differently shaped and sized pockets 22A, 24A throughout.

With reference to FIG. 3, the longitudinal sides 22, 24 shown have an irregular wave pattern defining at least one short wave SW and at least one long wave LW. The short-wave SW being defined as a wave with a peak that does not extend all the way to the mesh panel 30. The long wave LW being defined as a wave with a peak that does extend to the mesh panel 30.

In some embodiments, the short wave SW includes a peak spaced a distance from the mesh panel 30 that can range from 0 inches to 0.5 inches. Furthermore, at least one of the toughs is spaced a distance from the mesh panel 30 that can range from 0.5 inches to 1.5 inches. These distances change the profile design of the core 20 and can vary depending on the type of wall that is being constructed, for example, a load-bearing wall, a non-load-bearing wall, a partition wall, etc. For instance, of the panels 10 are used to construct an exterior non-bearing wall, the profile may be different than if the panels 10 are used to construct a simple partition wall. As just an example, in the case of a bearing wall where the dowels are positioned on the inside of the mesh panel 30, the trough distance from the panel 30 may range from 0.75 inches to 1.5 inches. The diameter of the dowels can also impact the profile shape of the core 20. In the case of a partition wall, the peak distance from the panel 30 can be zero, whereas the trough distance from the panel 30 can be 0.5. Other distances and profiles are contemplated within the full spirit and scope of the present invention.

Furthermore, in at least one embodiment, the layer of concrete or other material 50 may extend approximately one (1) inch from the panel 30, although other distances and thicknesses can be used depending on the specific application of the panels.

In addition, the irregular wave pattern of the first and second longitudinal surfaces 22, 24 of the core 20 of at least one embodiment may be defined by a plurality of differently spaced peaks and troughs meaning that the distant from one peak to the adjacent trough may be different than the distance from another peak to another trough, for example. This creates a series of differently shaped and spaced pockets 22A, 24A, throughout.

Moreover, it should also be noted that the nonlinear surface configuration of the first longitudinal surface 22 and the nonlinear surface configuration of the second longitudinal surface 24 may be identical to or substantially the same as one another. For example, if you were to trace the wave pattern or profile on the first longitudinal surface 22 and overlay that with the pattern or profile on the second longitudinal surface, the patterns or profiles would match in one embodiment. In other words, the wave patterns on both of the surfaces 22, 24 match one another such that a peak on one surface will correlate to or align with a trough on the other surface, and a trough on one surface will correlate to or align with a peak on the other surface.

In other embodiments, the longitudinal surfaces 22, 24 may be a mirror image of one another (not shown), or different from one another (not shown).

In any event, FIGS. 5A and 5B illustrate an exemplary panel assembly 100 with portions of the cores 20, mesh panels 30 and concrete layer 50 removed in order to show the different layers of the present invention.

Since other modifications and changes varied to fit particular operating requirements and environments will be apparent to those skilled in the art, the invention is not considered limited to the example chosen for purposes of disclosure, and covers all changes and modifications which do not constitute departures from the true spirit and scope of this invention. This written description provides an illustrative explanation and/or account of the present invention. It may be possible to deliver equivalent benefits using variations of the specific embodiments, without departing from the inventive concept. This description and these drawings, therefore, are to be regarded as illustrative and not restrictive.

Now that the invention has been described,

What is claimed is:

1. A construction panel assembly, comprising:

a core disposed between a first reinforcement mesh layer and a second reinforcement mesh layer, said core comprising a first surface and a second surface, said first surface being opposite said second surface, said first surface of said core comprising an irregular wave configuration defined by a plurality of peaks and a plurality of troughs, wherein at least one of said plurality of peaks of said first surface contacts said first reinforcement mesh layer, and wherein at least another one of said plurality of peaks of said first surface is disposed a distance from said first reinforcement mesh layer defining a space there between, said first surface defining a plurality of pockets sized to receive a reinforcement bar at least partially therein, each of said plurality of pockets of said first surface being defined by adjacent ones of said plurality of peaks of said first surface and a corresponding one of said plurality of troughs disposed there between, said second surface of said core comprising an irregular wave configuration defined by a plurality of peaks and a plurality of troughs, wherein at least one of said plurality of peaks of said second surface contacts said second reinforcement mesh layer, and wherein at least another one of said plurality of peaks of said second surface is disposed a distance from said second reinforcement mesh layer defining a space there between, said second surface defining a plurality of pockets sized to receive a reinforcement bar at least partially therein, each of said plurality of pockets of said second surface being defined by adjacent ones of said plurality of peaks of said second surface and a corresponding one of said plurality of troughs disposed there between, a plurality of connectors, each of said plurality of connectors being attached to said first reinforcement mesh layer and said second reinforcement mesh layer and extending through said core, wherein a first set of reinforcement bars secured to a building foundation are disposed at least partially within at least some of said plurality of pockets defined on said first surface of said core, and wherein a second set of reinforcement bars secured to a building foundation are disposed at least partially within at least some of said plurality of pockets defined on said second surface of said core, and wherein said first set of reinforcement bars are disposed between said first surface of said core and said first reinforcement mesh layer, and wherein said second set of reinforcement bars are disposed between said second surface of said core and said second reinforcement mesh layer.

2. The construction panel assembly as recited in claim 1 wherein said core comprises a foam material.

3. The construction panel assembly as recited in claim 1 wherein said irregular wave configuration of said first surface of said core is the same as said irregular wave configuration of said second surface of said core.

4. The construction panel assembly as recited in claim 1 wherein said irregular wave configuration of said first surface of said core is different than said irregular wave configuration of said second surface of said core.

5. The construction panel assembly as recited in claim 1 wherein at least some of said plurality of peaks of said first surface of said core are not uniformly spaced along said first surface.

6. The construction panel assembly as recited in claim 5 wherein at least some of said plurality of peaks of said second surface of said core are not uniformly spaced along said second surface.

7. The construction panel assembly as recited in claim 1 wherein at least some of said plurality of peaks of said first surface of said core are not aligned with other ones of said plurality of peaks of said first surface of said core.

8. The construction panel assembly as recited in claim 7 wherein at least some of said plurality of peaks of said second surface of said core are not aligned with other ones of said plurality of peaks of said second surface of said core.

9. The construction panel assembly as recited in claim 1 wherein at least some of said plurality of peaks of said first surface are disposed a distance of between 0.0 inches and 0.5 inches from said first reinforcement mesh layer.

10. The construction panel assembly as recited in claim 9 wherein at least some of said plurality of peaks of said second surface are disposed a distance of between 0.0 inches and 0.5 inches from said second reinforcement mesh layer.

11. The construction panel assembly as recited in claim 10 wherein at least some of said plurality of troughs of said first surface are disposed a distance of between 0.5 inches and 1.5 inches from said first reinforcement mesh layer.

12. The construction panel assembly as recited in claim 11 wherein at least some of said plurality of troughs of said second surface are disposed a distance of between 0.5 inches and 1.5 inches from said second reinforcement mesh layer.

13. The construction panel assembly as recited in claim 12 wherein said first reinforcement mesh layer and said second reinforcement mesh layer comprise a plurality of mesh panel openings with a width and a height, wherein said width and said height of said mesh are equal to one another.

14. The construction panel assembly as recited in claim 13 wherein said width and said height of said plurality of mesh panel openings are approximately three inches.

15. A building construction panel, comprising:

an insulation core comprising a first irregular nonlinear surface and a second irregular nonlinear surface, said first irregular nonlinear surface and said second irregular nonlinear surface being disposed on opposites sides of said insulation core, at least one first reinforcement mesh layer disposed along at least a portion of said first irregular nonlinear surface of said insulation core, and at least one second reinforcement mesh layer disposed along at least a portion of said second irregular nonlinear surface of said at least one insulation core, said first irregular nonlinear surface comprising a plurality of peaks extending toward said first reinforcement mesh layer, wherein at least one of said plurality of peaks of said first irregular nonlinear surface to contacts said first reinforcement mesh layer, and wherein another one of said plurality of peaks of said first irregular nonlinear surface is disposed in a spaced relation from said first reinforcement mesh layer, said second irregular nonlinear surface comprising a plurality of peaks extending toward said second reinforcement mesh layer, wherein at least one of said plurality of peaks of said second irregular nonlinear surface to contacts said second reinforcement mesh layer, and wherein than another one of said plurality of peaks of said second irregular nonlinear surface is disposed in a spaced relation from said second reinforcement mesh layer, wherein, after positioning a plurality of reinforcement bars between said first irregular nonlinear surface of said insulation core and said first reinforcement mesh layer, said first irregular nonlinear surface of said insulation core and said at least one first reinforcement mesh layer are at least partially covered with a layer of concrete in order to secure the plurality of reinforcement bars within said at least some of said plurality of pockets of said first nonlinear surface, and wherein, after positioning a plurality of reinforcement bars between said second irregular nonlinear surface of said insulation core and said second reinforcement mesh layer, said second irregular nonlinear surface of said insulation core and said at least one second reinforcement mesh layer are at least partially covered with a layer of concrete in order to secure the plurality of reinforcement bars within said at least some of said plurality of pockets of said second nonlinear surface.

16. The building construction panel as recited in claim 15 wherein said first irregular nonlinear surface of said insulation core is defined by a first irregular wave pattern, and said irregular nonlinear surface of said insulation core is defined a second irregular wave pattern.

17. The building construction panel as recited in claim 16 wherein said first irregular wave pattern of said first irregular nonlinear surface is the same as said second irregular wave pattern of said second nonlinear surface.

18. The building construction panel as recited in claim 17 wherein said first irregular wave pattern of said first irregular nonlinear surface is different than said second irregular wave pattern of said second nonlinear surface.

19. A building construction panel, comprising:

a foam insulation core comprising a first irregular nonlinear surface and a second irregular nonlinear surface, said first nonlinear surface being opposite said second nonlinear surface, said first irregular nonlinear surface and said second irregular nonlinear surface each comprising a plurality of pockets defined by a plurality of peaks and a plurality of troughs, at least some of said plurality of pockets of said first irregular nonlinear surface and at least some of said plurality of pockets of said second irregular nonlinear surface are sized to at least partially receive a reinforcement bar therein, wherein at least one of said plurality of peaks of said first irregular surface is not longitudinally aligned with at least one of the other plurality of peaks of said first irregular surface, and wherein at least one of said plurality of peaks of said second irregular surface is not longitudinally aligned with at least one of the other plurality of peaks of said second irregular surface, at least one first reinforcement mesh panel disposed along at least a portion of said first nonlinear surface of said foam insulation core, and at least one second reinforcement mesh panel disposed along at least a portion of said second nonlinear surface of said at least one foam insulation core, wherein at least one of said plurality of peaks of said first irregular surface contacts said first reinforcement mesh layer, and wherein at least another one of said plurality of peaks of said first surface is disposed a distance from said first reinforcement mesh layer defining a space there between, wherein at least one of said plurality of peaks of said second surface contacts said second reinforcement mesh layer, and wherein at least another one of said plurality of peaks of said second surface is disposed a distance from said second reinforcement mesh layer defining a space there between, and wherein said first irregular nonlinear surface of said foam insulation core and said at least one first reinforcement mesh panel are at least partially covered with a layer of concrete in order to secure a plurality of reinforcement bars at least partially within at least some of said plurality of pockets defined on said first irregular nonlinear surface, and wherein said second irregular nonlinear surface of said foam insulation core and said at least one second reinforcement mesh panel are at least partially covered with a layer of concrete in order to secure a plurality of reinforcement bars within at least partially within at least some of said plurality of pockets defined on said second irregular nonlinear surface.

* * * * *